United States Patent [19]

Shimamine

[11] Patent Number: 4,887,709

[45] Date of Patent: Dec. 19, 1989

[54] PACKAGE CONTAINER FOR A PAIR OF ORNAMENTS

[76] Inventor: Takazumi Shimamine, 152-2, Takenomaru Naka-ku, Yokohama-shi, Kanagawa-ken, Japan

[21] Appl. No.: 250,178

[22] Filed: Sep. 28, 1988

[30] Foreign Application Priority Data

Oct. 1, 1987 [JP] Japan ..... 62-150934

[51] Int. Cl.[4] ..... B65D 5/50

[52] U.S. Cl. ..... 206/45.14; 206/45.31; 206/457; 206/482; 206/495; 229/8

[58] Field of Search ..... 206/0.80, 0.84, 45.14, 206/45.31, 457, 458, 476, 477, 482, 495, 566; 229/16 D, 162

[56] References Cited

U.S. PATENT DOCUMENTS

| | | | |
|---|---|---|---|
| 1,952,071 | 3/1934 | Hunter | 206/482 |
| 2,024,984 | 12/1935 | Bradley | 206/476 |
| 3,144,131 | 8/1964 | Pitt et al. | 206/419 |
| 3,259,236 | 7/1966 | Cole | 206/476 |
| 3,609,450 | 9/1972 | Sheldon | 206/45.31 |
| 3,990,578 | 11/1976 | Roeser | 206/45.31 |
| 4,043,449 | 8/1977 | Love | 206/45.14 |
| 4,129,210 | 12/1978 | Brown et al. | 206/45.31 |
| 4,210,240 | 7/1980 | Fricano | 206/45.31 |
| 4,739,878 | 4/1988 | DiDomenico | 206/495 |

*Primary Examiner*—David T. Fidei

*Attorney, Agent, or Firm*—Cushman, Darby & Cushman

[57] ABSTRACT

Disclosed is a box-like package container for containing and displaying a pair of ornamental pieces for sale. Its inner rear wall has catch means for holding the ornamental pieces horizontally at separate positions; its front wall has a window opening large enough to give the sight of the ornamental pieces hung on the inner rear wall; and its rear wall has a hole at its top for permitting the hanging of the package. The lovely shape of the package is well matched with the ornaments contained inside, thereby causing attraction of castomers' attention to the ornaments inside. The package permits customers to have direct access to goods and feel free to select ornaments.

2 Claims, 5 Drawing Sheets

PACKAGE CONTAINER FOR A PAIR OF ORNAMENTS

BACKGROUND OF THE INVENTION

The present invention relates to a package for containing and displaying for sale a pair of ornamenral pieces which are matched to be worn together, such as earrings or ornaments worn on the earlobe.

As is well known, ornaments which are used a pair such as earrings or pierced ears are popular. In displaying for instance, pierced earrings for sale in show windows, the friction posts of a pair of pierced earrings are put into a piece of cardboard and they are secured by associated friction nuts behind. The cardboards each bearing a pair of pierced earrings are laid on the shelf, or are hang on the wall for sale. The cardboard is used only for the purpose of holding a pair of pierced earrings. In selling pierced earrings, sales person when asked by customers, to take out the ornaments, from the show case, and sometimes they recommend selected ornaments to customers. This is conducted in face-to-face relation with customers.

Such selling is appropriate for the purpose of preventing shoplifting, inducing customers to buy ornaments, and taking out selected ornaments from the show case, which prevents customers from having access to the ones which they want to have. Of course customers can ask a sales person to take out the ones which they like one after another until they have reached a final choice.

Then, the sales person removes the friction nut from the friction post of each pierced earring, thus removing the ornament from the card board. After that the ornaments are wrapped, and the customer receives the wrapped object.

Recently a variety of ornaments which are less expensive than the ones displayed for sale in jewelry shops, have been marketted. The face-to-face selling as described above is not appropriate for selling such less-expensive ornaments. Disadvantageously, such facetoface selling is likely to cause psychological pressure on customers, and therefore they cannot freely select the ones which they like. Shop managers will understand such situation, but they do not want to use pieces of cardboards for holding ornaments and put their goods in condition for customers' access as though they are cheap ornaments. They have a strong desire to induce customers to appreciate the value of goods from their appearance in display. Thus, a good compromise has been needed.

In selling such ornaments, sales person have to remove the friction nut form the friction post of each pierced earring and remove the ornament from the cardboards. After that she must insert the friction post of each pierced earring in the friction nut. This work is desirably omitted in selling less-expensive ornaments. Cardboards are appropriate for holding ornaments, but not pleasing to look to the ornaments held thereon.

SUMMARY OF THE INVENTION

The object of the present invention is to provide a package for containing and displaying for sale a pair of ornamental pieces which are mated for wear together, (1) permitting the selling of ornaments without causing psychological pressure on customers; (2) permitting realization of selling appropriate for less-expensive ornaments; (3) causing customers to appreciate the value of goods from their lovely pleasing appearance in display; and (4) reducing tedious work in wrapping.

To attain this object a package for containing and displaying for sale a pair of ornamental pieces according to the present invention comprises a boxlike package container having an inner space large enough to contain the pair of ornamental pieces, the inner rear wall of the boxlike package container having means for holding the ornamental pieces horizontally at separate positions from each other on the inner rear wall; the front wall of the boxlike package container having a window opening large enough to give the sight of the ornamental pieces hung on the inner rear wall; and the rear wall of the boxlike package container having a hole at its top for permitting the hanging of the package.

In use a pair of ornaments such as pierced ears are caught by holding means on the inner rear wall of the boxlike package container. Customers can have a good view of the ornaments in the package through its window opening, presenting a lovely pleasing look. The package can be hung on the wall with a pin in its top hole, thereby permitting customers to have an access to the ornaments. When selected by a customer, the package can be passed to the customer without wrapping the same.

Other objects and advantage of an ornament package container according to the present invention will be understood from the following description of a preferred embodiment which is shown in accompanying drawings:

DESCRIPTION OF THE PREFERRED EMBODIMENT

Figure 1:
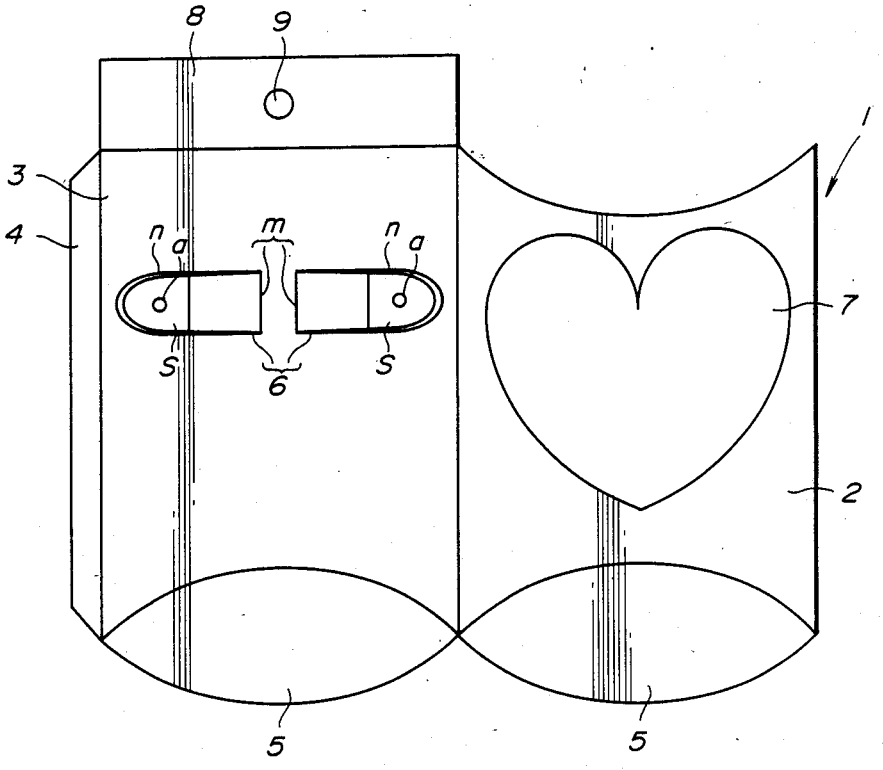
FIG. 1 shows a flat extension of package container according to the embodiment of the present invention prior to formation into a box-like container.
Figure 2:
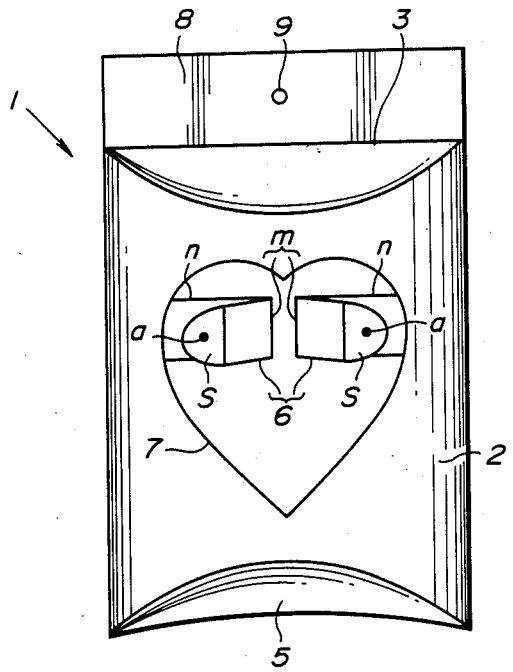
FIG. 2 is a front view of the package container.
Figure 3:
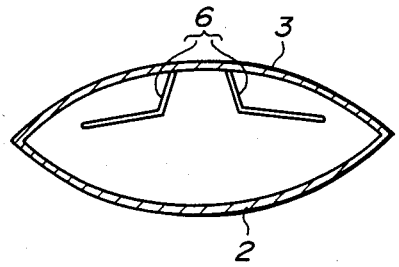
FIG. 3 is a plane view of the package container.
Figure 4:
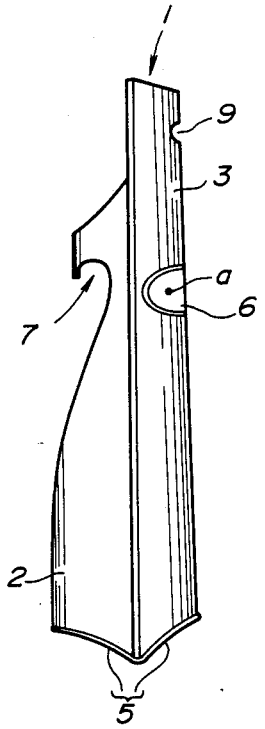
FIG. 4 is a side view of the package cotainer.
Figure 5:
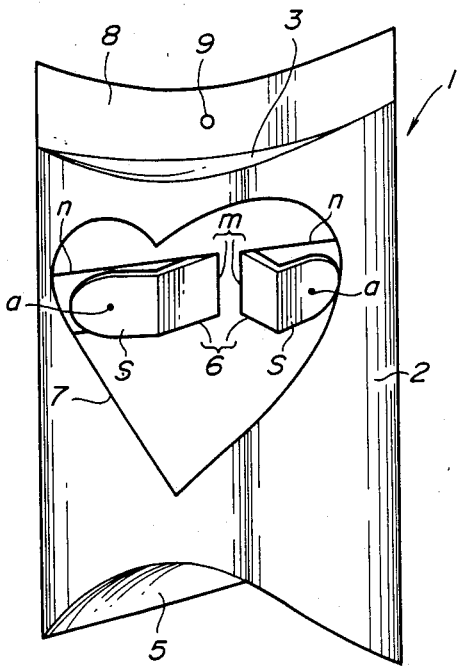
FIG. 5 is a perspective view of the package container.

First, referring to FIGS. 1 to 5, the package 1 is extended flat in the form of rectangular sheet prior to formation into a box-like container. The front 2 is folded over the back 3, and is starched to the back along its margin 4. Thanks to the convex bottoms 5 the resultant box-like package container has front and back surfaces curved outward, as seen from FIG. 2 to 5. The inner rear wall 3 of the package container has a pair of catch pieces 6 for catching a pair of earrings or pierced ears. These catch pieces 6 project somewhat forward to display the ornaments in an attractive fashion. Specifically each catch piece is formed by cutting the back 3 along semi-ellipse contour as indicated at "n", leaving its end "m" uncut. The semi-ellipse "s" is raised and bent to extend its major part above the rear wall surface.

As shown, the front 2 has a window opening 7 so that customers may view the ornaments contained in the package container. The catch pieces 6 partly appear from behind the ornaments. The window opening 7 in this particular embodiment has a shape of a heart.

The back 3 is somewhat longer than the front 2 to provide an extra margine 8, in which a hole 9 is made for suspention.

The window opening 7 may have a shape other than a heart. The bottom tabs 5 may have a shape other than convex, and then the package container may have a corresponding three dimensional shape in conformity with the shape of the bottom tab. These bottom tabs may be omitted. Coated paper or plastic sheet may be used. The sheet material of different colors may be used, but pastel colors for instance of yellow or pink are appropriate for producing a lovely appearance.

The catch pieces 6 is described as being appropriate for holding a pair of pierced earrings. It may be modified so as to be appropriate for holding earrings for unpierced ears although its structure is essentially same.

Figure 6:
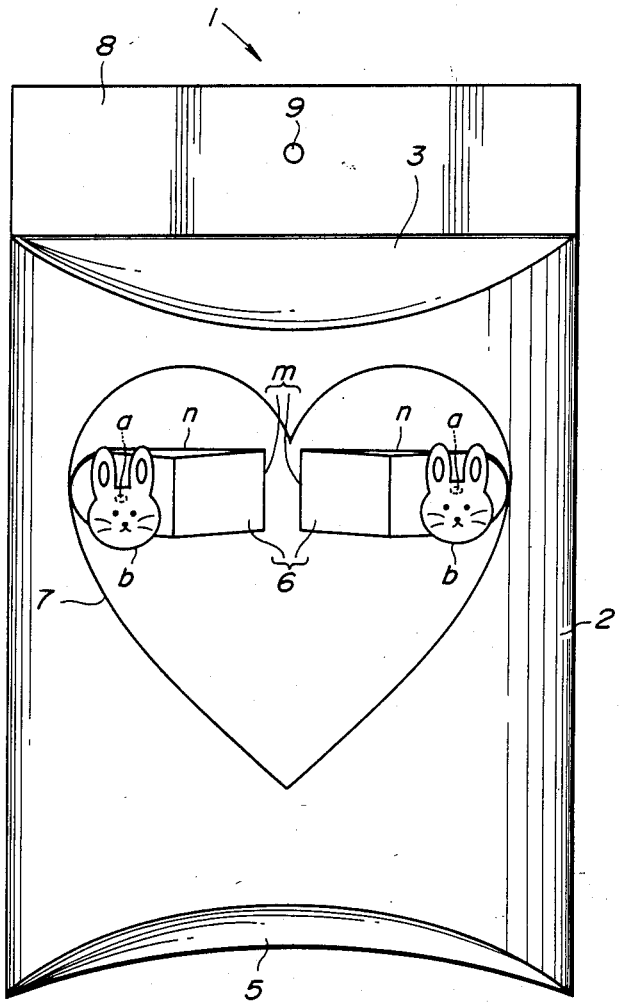
FIG. 6 is a front view of the package container with a pair of pierced ears hung on its inner rear wall.
Figure 7:
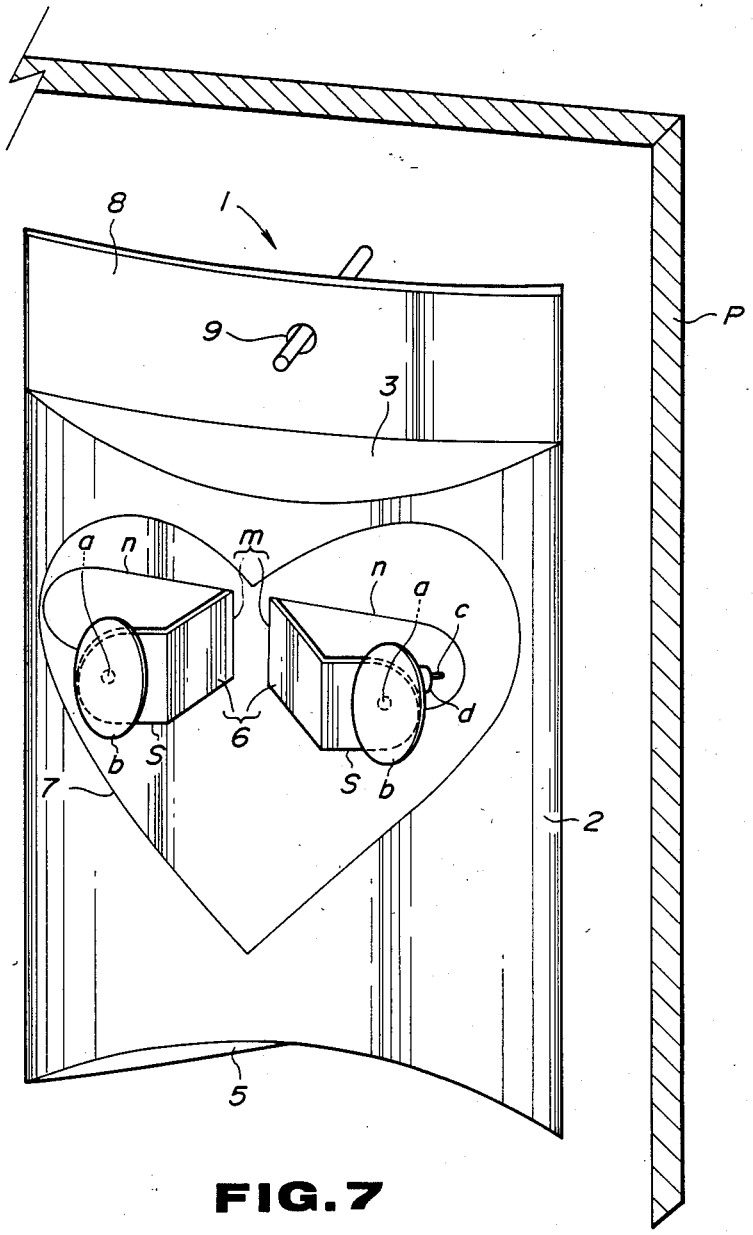
FIG. 7 is a perspective view of the package container used in the shop.

In use, specifically in displaying a pair of pierced earrings for sale (See FIGS. 6 and 7), the friction post "c" of each ornament "b" is inserted in the hole "a" of each catch piece 6, and the friction post "c" is caught by the friction nut "d" behind. The package is hung for sale, permitting customers to have direct access to the ornaments without bothering themselves about sales persons. The package container has a nice attractive appearance, and therefore customers will justly appreciate the value of the ornaments contained therein. The problem of psychological pressure on customers in face-to-face selling as described earlier is eliminated, permitting self-selection and self-service.

Composed with a conventional cardboard mount, attractiveness and loveliness are increased as a whole. The sight of the ornaments inside through its widow opening of lovely shape such as heart, will attract customers' attention. Particularly young customers are likely to choose goods on the basis of the impression which they had at the first sight. Of course elder people will have a favourable impression from the lovely appearance of the package container and the ornaments matched together as well.

Also, advantageously the tedious work of removing the ornaments from the cardsboard mount, putting them in a case and wrapping them in a case and wrapping the same, are not necessary. The package may be put in a bag in place of wrapping. Retailers can supply whole sale dealers with package containers, asking them to put ornaments in package containers. Then, retailers will be free from the trouble of attaching ornaments to cardboard mounts. The price may be printed on the top margine 8 of the back 3 of the package container.

What is claimed is:

1. A package for housing and displaying a pair of jewelry pieces comprising: a box-like package container having an inner space large enough to house the jewelry pieces, said box-like package having an inner rear wall including a pair of flaps for holding the jewelry pieces horizontally in spaced apart relationship and a front wall having a window opening, said rear wall having a hole at its top for permitting the hanging of the package.

2. A package as in claim 1 wherein each said jewelry piece has a post portion and said flaps have a hole sized and shaped so that said post portion fits therein.

* * * * *